US005588500A

United States Patent [19]

Yonahara

[11] Patent Number: 5,588,500

[45] Date of Patent: Dec. 31, 1996

[54] ELEVATABLE WORK FACILITY

[75] Inventor: Yoshihiro Yonahara, Ohmiya, Japan

[73] Assignee: Japan Steels International Inc., Tokyo, Japan

[21] Appl. No.: 346,230

[22] Filed: Nov. 22, 1994

[30] Foreign Application Priority Data

Sep. 14, 1994 [JP] Japan ..... 6-247017

[51] Int. Cl.[6] ..... E04G 1/18

[52] U.S. Cl. ..... 182/141; 182/113; 182/115; 182/127

[58] Field of Search ..... 182/40, 93, 101, 182/113, 115, 127, 141, 148, 207

[56] References Cited

U.S. PATENT DOCUMENTS 3,891,055 6/1975 Medlock .

FOREIGN PATENT DOCUMENTS 3509833 11/1986 Germany .
9203855 11/1992 Germany .
9201136 12/1992 Germany .
1358384 7/1974 United Kingdom .

*Primary Examiner*—Robert W. Gibson, Jr.
*Assistant Examiner*—Richard M. Smith
*Attorney, Agent, or Firm*—Wenderoth, Lind & Ponack

[57] ABSTRACT

A scaffolding floor is provided on the upper ends of four expandable and contractible struts. A support frame protrudes downward from the scaffolding floor. An end of a line is connected to the lower end of the support frame and the other end of the line is connected to the fixed part of a hydraulic jack which is provided in the lower part of the struts, so that the scaffolding floor can be elevated or lowered through the line in accordance with the raising or lowering of the hydraulic jack.

15 Claims, 4 Drawing Sheets

ELEVATABLE WORK FACILITY

BACKGROUND OF THE INVENTION

1. Field of the Invention

The present invention relates to a work facility of a height used at a construction site and the like and, more particularly, it concerns a work facility of a type which is capable of being elevated or lowered so that the height of the scaffolding floor can be changed.

2. Description of the Prior Art

Conventionally, in the case where construction work is carried out in high places such as along ceilings or at positions high up a wall, a framework has been constituted by employing pipes and clamps along a wall and planking that has been held on the framework so that the construction worker can stand thereon. Otherwise, a plurality of construction frames which are respectively composed of the combinations of studs and horizontal components has been arranged in the vertical direction. The connecting sections of such construction frames have been respectively engaged by means of fittings so as to form a set of construction frames. The set of construction frames thus formed have then been arranged at front and back positions so that they are situated opposite to each other. Intersecting brace struts have been connected to the opposed studs so that a working surface equipped with a scaffolding floor provided on the upper parts of the studs is arranged. Thus, the construction worker climbed onto the scaffolding floor and worked.

However, in the case of the above mentioned conventional work facility, once the work facility was set in place, it was difficult to adjust the height of the scaffolding floor. Therefore, situations have arisen in which the construction workers were prevented from performing their required duties. Furthermore, since the work surface for high places is tall, problems have arisen in that the work facility cannot be loaded on an elevator for temporary work unless it is disassembed.

SUMMARY OF THE INVENTION

The present invention overcomes the above described problems of the prior art, and an object of the present invention is to provide an elevatable work facility which is smoothly elevated and lowered and in which the height of the scaffolding floor can be changed by forming the work facility in such a manner that it can be elevated and lowered.

Another object of the present invention is to provide a work facility in which it is ensured that a scaffolding floor can be secured at an arbitrary height and the movement of the scaffolding floor is easy.

Still another object of the present invention is to provide an elevatable work facility with which an elevation and lowering operation is readily carried out and a construction worker can easily go up and down.

According to the present invention, there is provided an elevatable work facility which solves the above-stated problems and which comprises at least four struts provided at the four corners at the front, back, left, and right sides; each of the struts having an outer casing and an inner casing which is telescopically insertable into the outer casing from its upper end; suitably spaced apart transverse rods provided between the outer casings of the four struts and connecting them; a scaffolding floor, each of the inner casings having an upper end connected to each of the four corners of the scaffolding floor; a jack attached to a frame parallel with the struts, the frame being attached between the lower parts of the struts; a pulley provided at the end of the jack;a line having one end engaged with a fixed part on the jack side; and a support frame protruding downward from the lower surface of the scaffolding floor, the other end of the line being fixed to the lower end of the support frame through the pulley, wherein the scaffolding floor can be elevated or lowered in accordance with the raising and lowering of the jack.

Further, a fixing means for fixing the struts at an arbitrary length is provided at the upper ends of the respective struts and, at the same time, wheels are provided at the lower ends of the respective struts, so that the scaffolding floor is prevented from sliding upon use and the scaffolding floor can be easily moved.

Still further, a guide frame in parallel with the jack is provided between the lower parts of the struts, and guide components are provided between the guide frame and the support frame protruding downward from the scaffolding floor.

Furthermore, a ladder is suspended downward from the outer peripheral edge of the scaffolding floor, and a guide frame is provided on the outer surface between the struts which corresponds to the ladder and guide components are provided between the ladder and the guide frame.

According to the above-described elevatable work facility, because the line is engaged on the pulley at the upper end of the jack which is provided on one side of the work facility, the one end of the line is engaged with the side surface of the jack and the other end of the line is engaged with the lower end of the support frame extending in the vertical direction from the lower surface of the scaffolding floor, the scaffolding floor can be elevated or lowered by raising or lowering the jack.

This elevatable work facility is employed in such a way that the scaffolding floor is jacked up and raised to an arbitrary height. When the work facility is not being used, the scaffolding floor is lowered by lowering the jack and the work facility can be moved with ease utilizing the wheels attached to the lower ends of the respective struts.

Additionally, in a case where the fixing means for fixing the struts at any length are provided in the respective struts, it is ensured that the scaffolding floor can be secured at an arbitrary height.

When the scaffolding floor is elevated or lowered, the lower parts of the support frame protruding downward from the scaffolding floor are guided by the guide components, so that the scaffolding floor can be smoothly raised or lowered. Furthermore, since the ladder is also guided by the guide components disposed between the struts, the ladder can be elevated or lowered without rattling.

The invention can be further understood with reference to the following illustrations of preferred embodiments of the invention;

DESCRIPTION OF THE PREFERRED EMBODIMENTS

Figure 1:
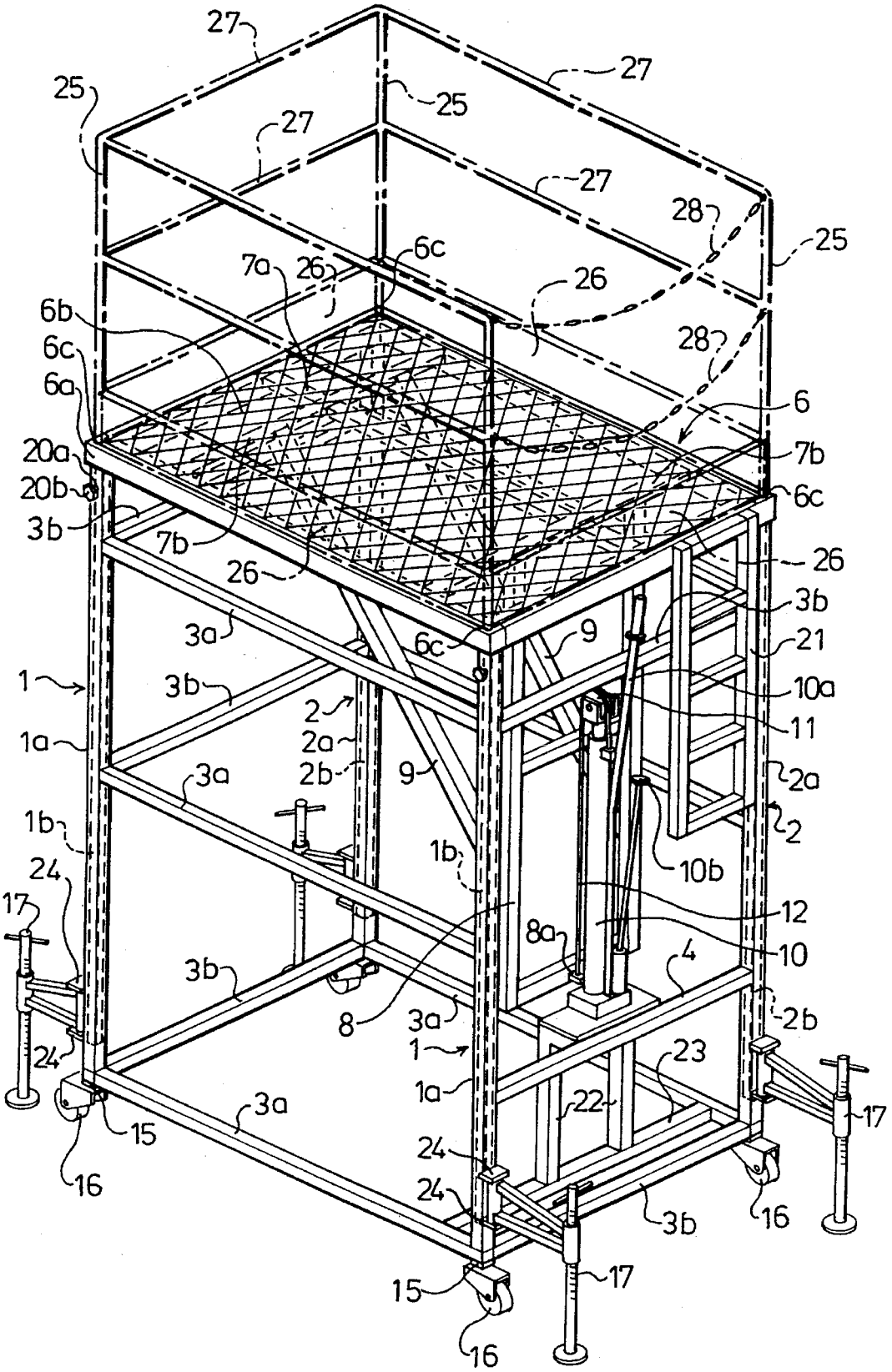
FIG. 1 is a perspective view showing an embodiment of an elevatable work facility according to the present invention.
Figure 2:
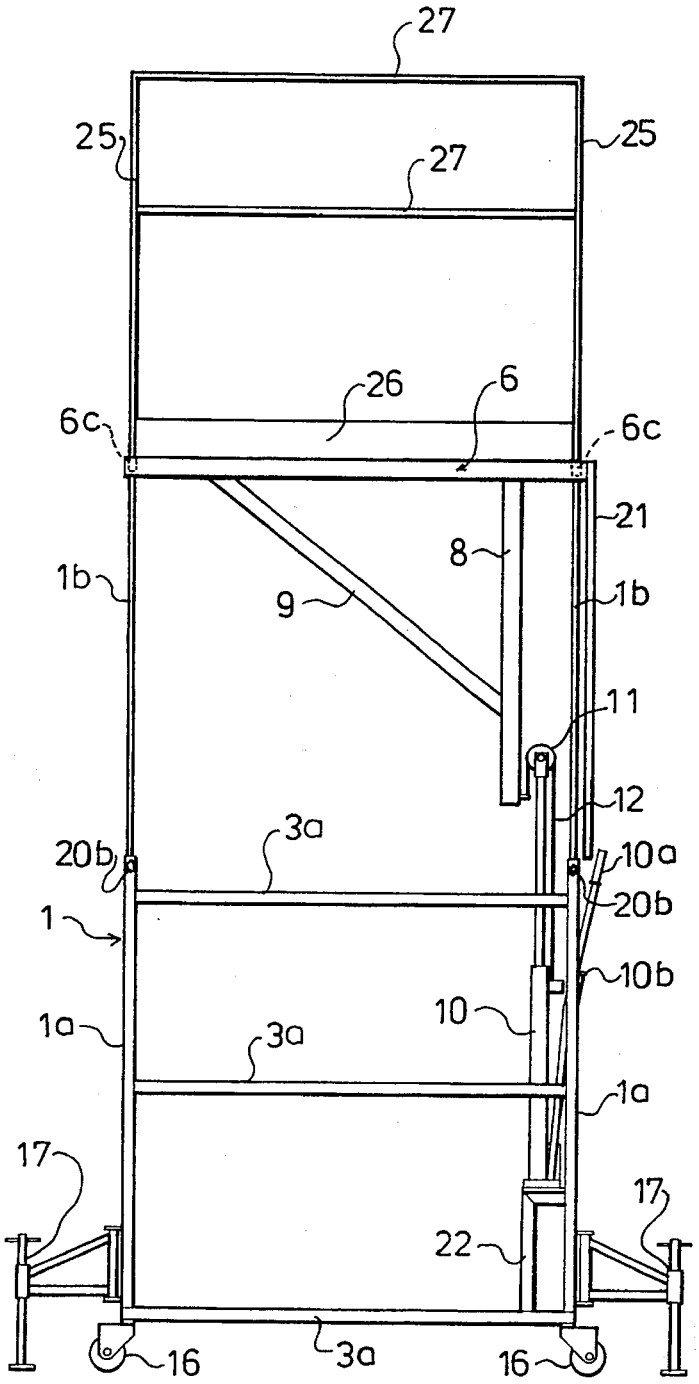
FIG. 2(*a*) is a front view illustrating a state in which the elevatable work facility is elevated, and FIG. 2(*b*) is a side view under the same condition.
Figure 2:
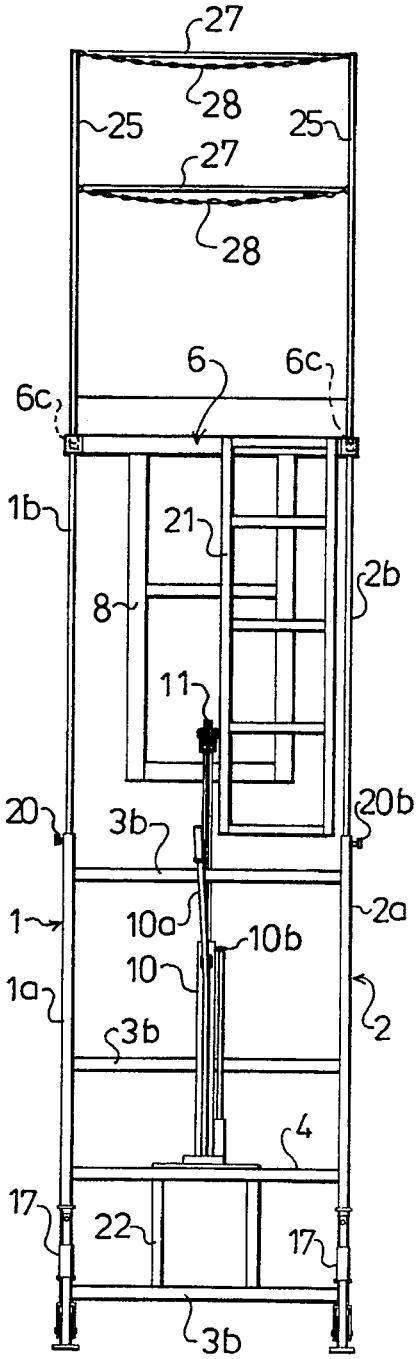

Referring to FIGS. 1 and 2, an embodiment of an elevatable work facility according to the present invention will be described in the following.

In FIG. 1, struts 1 and 2 are respectively provided at the four positions of a rectangular shape. Each of the struts 1 and 2 for the front and back is respectively formed in the shape of a double cylinder having an outer casing 1*a* or 2*a* an inner casing 1*b* or 2*b*, and is expandable or contractible. At the upper part of each outer casing 1*a* or 2*a* of the strut 1 or 2, a tapped hole 20*a* is opened. An engagement bolt 20*b* is provided in the tapped hole 20*a*. The double cylinder constituting each of the struts 1 and 2 is adjusted to an arbitrary length by a jack 10 which will be described later. The engagement bolt 20*b* which is provided in each of the outer casings 1*a* and 2*a* is then fastened so that each of the struts 1 and 2 can be secured in such a way that it is not expanded or contracted. It is generally considered that pin holes are provided in the upper parts of the outer casings 1*a* and 2*a*, and, at the same time, pin holes are provided at suitable intervals in the longitudinal direction on the inner casings 1*b* and 2*b*, the struts 1 and 2 are adjusted to an appropriate length, and then a fixing means is so constructed as to pass pins through the pin holes of the outer casings 1 and 2 respectively aligned with the pin holes of the inner casings 1 and 2 to fix the appropriate length of the struts.

Transverse rods 3*a* are respectively provided at an upper position, a lower position, and an intermediate position between the two outer casings 1*a* on a front side. Transverse rods 3*a* are also respectively provided at an upper position, a lower position, and an intermediate position between the two outer casings 2*a* on the back. Additionally, transverse rods 3*b* are provided at positions corresponding to those of the above described transverse rods 3*a* but located between the front outer casing 1*a* and the back outer casing 2*a* on the left side. The transverse rods 3*b* are provided at the upper and lower positions between the front outer casing 1*a* and the back outer casing 2*a* on the right side. A transverse rod 4 is provided at a position adjacent to the lower transverse rod 3*b*. Thus, the four struts 1 and 2 are respectively connected.

A horizontal component 23 is provided at a position near the transverse rod 3*b* at the right side between the front and back transverse rods 3*a*. Between the horizontal component 23 and the transverse rod 4 near the lower part of the right side, a frame 22 of a substantially inverted L shape in section is attached. On the upper surface of the frame 22, a hydraulic jack 10 which can be raised and lowered by manual operation is arranged in parallel with the struts 1 and 2.

The hydraulic jack 10 can be raised, for example, by setting an elevation switch lever 10*b* to an "up" position and operating and rocking an operating lever 10*a* forward and backward. The elevation switch lever 10*b* is switched to a "down" position so that the hydraulic jack 10 can be lowered. On the upper end of the hydraulic jack 10, a pulley 11 is provided which guides a wire as a line for connecting the lower end of a support frame, which will be described hereafter, to the fixed part of the jack. It should be noted that a motor-driven hydraulic jack and the like designed to supply hydraulic pressure to a hydraulic cylinder by an electrically operated motor and so on, as well as the hydraulic jack which is raised or lowered by manual operation, can be utilized.

The upper ends of the inner casings 1*b* and 2*b* of the respective struts 1 and 2 are connected to four corners of a scaffolding floor 6. A reinforcement component 7*a* is provided in the direction of the longer side on the inside of a floor frame 6*a*. Two reinforcement components 7*b* are provided in the direction perpendicular to that of the reinforcement component 7*a* in the vicinity of the shorter sides of the floor frame 6*a*. The upper surface of the floor frame 6*a* is covered with a floor board 6*b* formed, for example, using metal laths. Otherwise, a plate or the like provided with a number of antislip protrusions may be used for the floorboard 6*b*. For going up to and down from the scaffolding floor 6, a ladder 21 is provided downward from the peripheral edge part at the right side of the scaffold floor 6. It should be understood that the ladder 21 can be provided not only at the right side of the scaffolding floor 6 but also at any position on the outer periphery of the scaffolding floor 6. A construction worker can climb up to the scaffolding floor 6 by using the transverse rods 3*a* or 3*b* arranged at appropriate intervals between the outer casings 1*a* and 2*a* of the elevatable work facility.

In the neighborhood of the hydraulic jack 10 below the reinforcement component 7*b* on the right side of the scaffolding floor 6, a support frame 8 of a substantially rectangular shape in section is attached and extends vertically downward. Between the lower side of the other reinforcement component 7*b* and the intermediate parts of the support frame 8, two support rods 9 are attached slantwise. While one end of a wire 12 is engaged with a protruding plate 8*a* provided on the outside of the lower end of the support frame 8, the other end of the wire (elongated flexible member) 12 is engaged with the fixed side of the hydraulic jack 10, which is an outer side surface of the upper end of a cylinder in the present embodiment, through the pulley 11 located at the top end of the hydraulic jack 10. As a result, the support frame 8 is connected to the hydraulic jack 10 through the wire 12. The length of the wire 12 is so adjusted as to be rather longer than the stroke length of the hydraulic jack 10.

Although, because the support frame 8 is located at a position which is slightly separated from the center portion of the lower surface of the scaffolding floor 6, it is reinforced by the two support rods 9, if the support frame 8 is provided at the center portion of the scaffolding floor, then, the support rods 9 for reinforcement will not be necessary. In this case, the hydraulic jack 10 may also be arranged at the center part between the four struts.

When the hydraulic jack 10 is extended, the support frame 8 is pulled by the wire 12 and slides upward so that the scaffolding floor 6 attached to the upper end parts of the support frame 8 and the support rods 9 is elevated.

Furthermore, when the elevation switch lever of the hydraulic jack 10 is switched downward, the hydraulic jack 10 is contracted because of the weight of the scaffolding floor 6, the support frame 8 is lowered through the wire 12, and then the scaffolding floor 6 is lowered. The length of the support frame 8 is so adjusted that the wire 12 is not loosened while the hydraulic jack 10 is contracted.

On the lower ends of the outer casings 1*a* and 2*a* of the respective struts 1 and 2, wheels 16 are provided through universal joint journals 15 so as to be oriented in any direction. Therefore, the elevatable work facility can be moved easily. In addition, protruding plates 24 are provided on two upper and lower positions of the lower ends in the respective outer casings 1*a* and 2*a*. The base ends of an outrigger 17 are rotatably journaled between the upper and lower protruding plates 24. In the case in which the elevatable work facility is used, the outriggers 17 can be positioned so as to protrude in the periphery of the outer casings 1*a* and 2*a* so that the elevatable work facility is not overturned or moved. When the elevatable work facility is not being used, the outriggers 17 are folded and accommodated in the side surfaces of the elevatable work facility.

Guard rail struts 25 are attached upright in holes 6*c* provided at the four corners of the scaffolding floor 6 and guard rails 27 are attached between the respective guard rail struts 25 so that the safety of the work area is attained. Furthermore, side plates 26 are provided between the lower ends of the respective guard rail struts 25 so that small articles, equipment, tools, and the like are prevented from dropping from the upper surface of the scaffolding floor 6. On the side on which the ladder 21 of the scaffolding floor 6 is provided, chains 28 which are removable are provided in place of the guard rails 27.

When the elevatable work facility having the above-stated construction is employed for interior finish work such as for a ceiling and the like, the work facility is moved to the construction site while it is still contracted (the hydraulic jack 10 is lowered). Then, while the elevation switch lever 10*b* of the hydraulic jack 10 is set to its "up" position, the operating lever 10*a* is rocked and operated forward and backward so that the scaffolding floor is raised and the elevation thereof is stopped at a height suitable for the work being done.

After that, the engagement bolts 20*b* provided at the upper ends of the respective outer casings 1a and 2*a* of the struts 1 and 2 are fastened so that the inner casings 1*b* and 2*b* are fixed. Thus, the load which is imposed on the jack 10 or the wire 12 can be reduced. On the upper surface of the scaffolding floor 6, the guard rail struts 25 are arranged upright, and the side plates 26, the guard rails 27, and the chains 28 are attached. The outriggers 17 installed on the lower ends of the respective struts 1 and 2 are projected and secured, so that the elevatable work facility is not overturned or moved.

After the elevatable work facility is expanded, the construction worker can readily climb up to the upper surface of the scaffolding floor 6 by the use of the transverse rods 3*b* or the ladder 21 on the side surface of the work facility.

Subsequently, when the elevatable work facility is accommodated, the guard rails 27 and the like disposed on the upper surface of the scaffolding floor 6 are removed and the engagement bolts 20*b* on the upper surfaces of the respective outer casings 1*a* and 2*a* are unfastened. Then, when the elevation switch lever 10*b* is switched to its "down" position, the hydraulic jack 10 is forced to lower owing to the weight of the scaffolding floor 6. Therefore, the elevatable work facility can be lowered, moved, and stored.

Although, in the above mentioned embodiment, the pulley is provided at the upper end of the hydraulic jack, and the wire is employed as a line for connecting the lower end of the support frame to the outer side surface on the upper end of the cylinder of the jack, it should be noted that a gear may be provided at the upper end of the hydraulic jack and a chain may be provided for the connection between the lower end of the support frame and the outer side surface of the upper end of the cylinder of the jack, so that the scaffolding floor 6 is elevated in accordance with the raising and lowering of the hydraulic jack.

Figure 3:
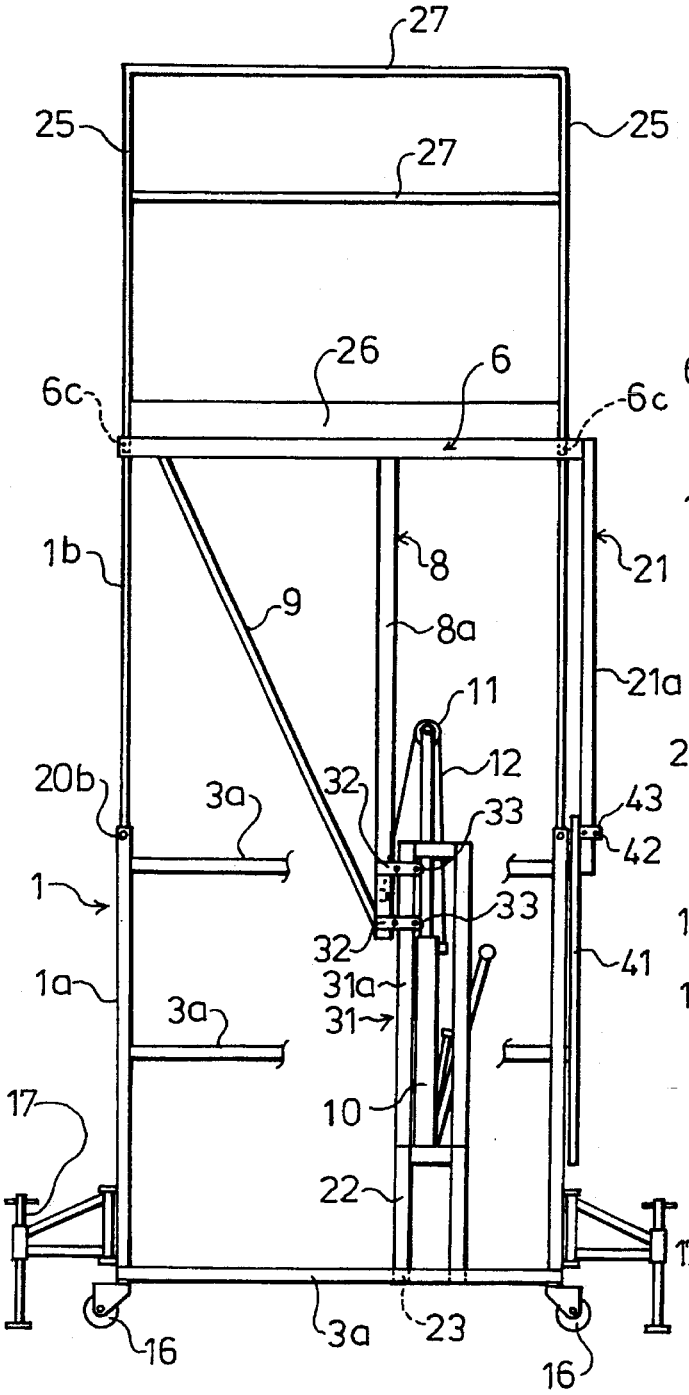
FIG. 3(*a*) is a front view illustrating a state in which an elevatable work facility according to a second embodiment is elevated, and FIG. 3(*b*) is a side view under the same condition.
Figure 3:
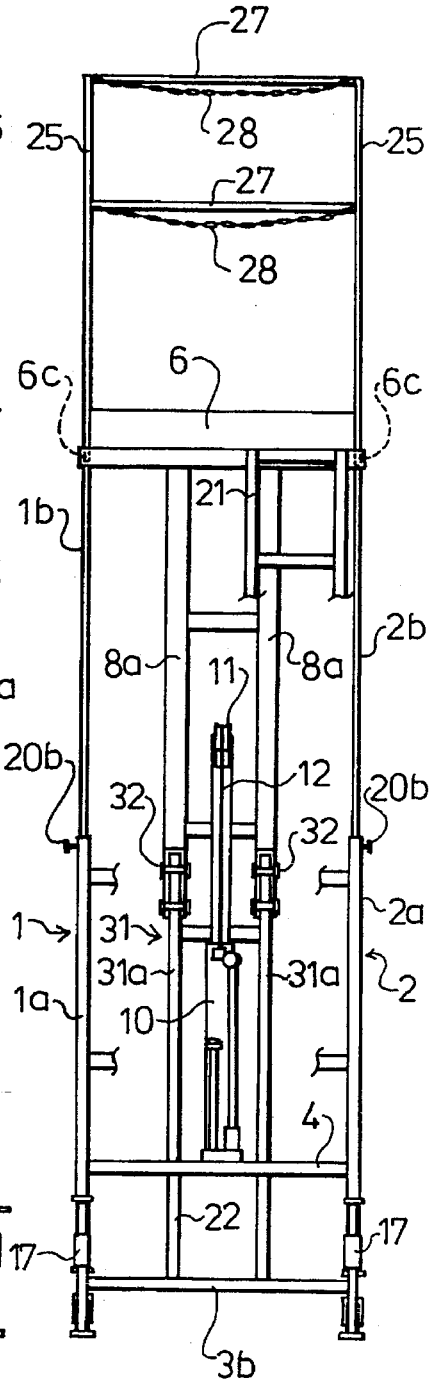

Next, with reference to FIG. 3(A) and 3(B), an elevatable work facility according to a second embodiment of the present invention will be described.

In this embodiment, a hydraulic jack 10 is arranged at a position near to a central position which is surrounded by four struts and fixed to a horizontal component 23 between the lower parts of the struts through a frame 22. A guide frame 31 is provided adjacent to the hydraulic jack 10 (or encloses the hydraulic jack 10) and in parallel with the hydraulic jack 10. The lower ends of the guide frame 31 are supported on the frame 22. The guide frame 31 is composed of four vertical strut rods 31*a* which are connected by horizontal connection components. The guide frame 31 can be formed integrally with the frame 22 as a unitary component. A support frame 8 protruding downward from the scaffolding floor 6 is strengthened by reinforcement rods 9. The support frame 8 is constituted of two vertical rod components 8*a* which are connected by a horizontal component and arranged at a position corresponding to that of the guide frame 31. Guide components 32 are provided at the lower parts of the rod components 8*a* at both sides. The guide components 32 are provided at two positions. The guide components 32 are provided respectively with rollers 33 which can slide while holding the strut rods 31*a* of the guide frame between the guide component and the rollers. Therefore, when the scaffolding floor 6 is raised or lowered, the lower part of the support frame 8 is designed to be guided by the guide frame 31 through the guide components 32.

Similarly, in the second embodiment, if the support frame 8, the hydraulic jack 10, and the guide frame 31 are arranged in the central part on the lower part of the scaffolding floor 6, then, the reinforcement support rods 9 will not be needed.

A wire 12 for connecting the fixed part of the hydraulic jack 10 to the lower part of the support frame 8 is engaged on a rotary member such as a pulley 11 provided at the end of the jack, and the wire is operated so that the scaffolding floor 6 is elevated or lowered as in the case of the first embodiment.

Although, in the present embodiment, the guide components 32 are provided on the lower parts of the support frame 8 arranged in the scaffolding floor side, the guide components 32 may instead be provided on the upper parts of the guide frame 31 so that the support frame 8 on the scaffolding floor side is guided by the guide components 32 on the guide frame side and the support frame 8 is slid.

Furthermore, a guide frame 41 is provided on the outer surface between the struts which corresponds to the position of a ladder 21 suspended from the outer peripheral edge of the scaffolding floor 6. When the scaffolding floor 6 is elevated or lowered, the ladder 21 is elevated or lowered by the guide of the ladder-shaped guide frame 41 in a manner similar to that of the elevation and lowering of the above stated support frame 8. At the upper parts of the guide frame 41, guide components 42 are provided and respectively have rollers 43. The rollers 43 hold vertical rods 21*a* of the ladder 21 between the rollers and the guide frame so that the ladder 21 is guided to be elevated or lowered. It should be understood that the guide components 42 may be provided on the lower parts of the ladder 21 in place of the guide components 42 being provided on the guide frame 41. In this case, the guide components 42 provided on the lower parts of the ladder 21 are designed to be guided by the guide frame 41. In addition, the guide frame 41 is so constructed as to have the function of a ladder.

The elevatable work facility according to the second embodiment of the present invention has such a construction as mentioned above and other constructions and operations are the same as those of the first embodiment.

Figure 4:
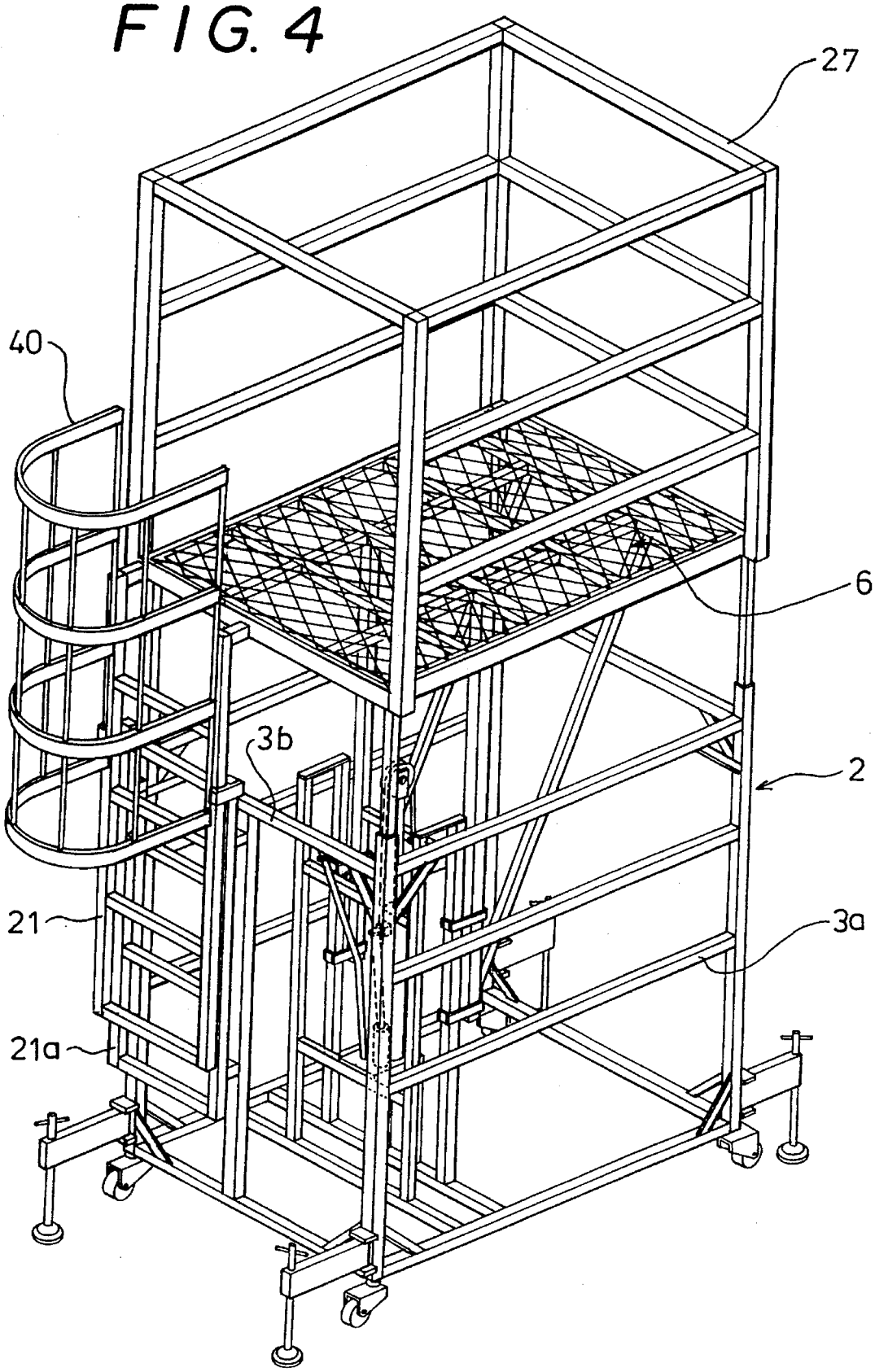
FIG. 4 is a schematic perspective view showing a back protection guide provided for ladder in the above embodiments.

Further stated, in these embodiments, a back-protection guide 40 can be provided so as to cover the ladder 21 as can be seen in FIG. 4. Accordingly, the safety of an operator going up and down the ladder 21 can be ensured. The back-protection guide 40 is provided on the part of the ladder 21 which is attached to the scaffolding floor 6 side and is not provided on a ladder 21*a* attached to the transverse rods 3*b*, so that the back-protection guide 40 can be raised or lowered without difficulty.

As mentioned above, according to the elevatable work facility of the present invention, since the scaffolding floor can be set to an arbitrary height by raising or lowering the jack, the construction worker can work at a work facility suitable for the construction place. Further, the work facility can be simply moved or stored. In the case where the fixing means for fixing the struts at any length are provided on the respective struts, the scaffolding floor is not lowered due to a malfunctioning of the jack and the load imposed on the jack is reduced with safety.

Further, since the guide frame is provided along the support frame which protrudes downward from the scaffolding floor, the scaffolding floor can be smoothly elevated or lowered by the operation of the jack. Furthermore, since the guide frame is also provided for the ladder suspended downward from the scaffolding floor, the ladder does not rattle upon the raising and lowering of the ladder or when construction personnel go up or go down the ladder.

It will be appreciated that other configurations may be used in accordance with the present invention without departing from the scope and spirit of the invention.

What is claimed is:

1. An elevatable work facility comprising:

a substantially horizontal scaffolding floor having four corners;

four substantially vertical struts respectively comprising four substantially vertical first casings having upper ends respectively connected to said four corners of said scaffolding floor, and four substantially vertical second casings respectively telescopically coupled with said first casing, one of said first casing and said second casing constituting outer casing and the other of said first casing and said second casing constituting inner casing;

a plurality of transverse rods connected between said outer casings of said struts;

a jack supporting frame fixed between lower parts of said struts;

a fluid-actuated jack attached to said jack supporting frame and extending substantially vertically in parallel to said struts, said jack including a cylinder and a piston slidably mounted in said cylinder, one of said cylinder and said piston being fixed to said jack supporting frame and constituting a fixed jack member, and the other of said cylinder and said piston constituting a movable jack member;

a rotary member rotatably mounted to an upper end of said movable jack member;

a support frame protruding downwardly from said scaffolding floor; and an elongated flexible member having a first end fixed to said fixed jack member, a second end fixed to said support frame, and an intermediate portion engaged about said rotary member;

whereby movement of said movable jack member a first distance relative to said fixed jack member causes said scaffolding floor to be moved substantially twice said first distance.

2. An elevatable work facility as recited in claim 1, further comprising a substantially vertical guide frame fixed between lower parts of said struts; and guide components mounted to one of said guide frame and said support frame and slidably engaging the other of said guide frame and said support frame.

3. An elevatable work facility as recited in claim 2, wherein said guide components have rollers for engaging said other of said guide frame and said support frame.

4. An elevatable work facility as recited in claim 1, further comprising fixing means for selectively fixing said outer casings of said struts to said inner casings of said struts, respectively, to fix said struts at a selected height.

5. An elevatable work facility as recited in claim 1, further comprising wheels mounted at lower ends of said struts, respectively.

6. An elevatable work facility as recited in claim 1, further comprising a ladder suspended downwardly from an outer peripheral edge of said scaffolding floor; and a ladder guiding frame mounted to said struts for guiding vertical movement of said ladder as said struts are adjusted in height.

7. An elevatable work facility as recited in claim 6, further comprising a back protection guide mounted to said ladder for surrounding a person climbing said ladder.

8. An elevatable work facility as recited in claim 1, wherein said fluid-actuated jack comprises a hydraulic jack.

9. An elevatable work facility comprising:

a substantially horizontal scaffolding floor having four corners;

four substantially vertical struts respectively comprising four substantially vertical first casings having upper ends respectively connected to said four corners of said scaffolding floor, and four substantially vertical second casings respectively telescopically coupled with said first casings, one of said first casings and said second casings constituting outer casings and the other of said first casings and said second casings constituting inner casings;

a plurality of transverse rods connected between said outer casings of said struts;

a jack supporting frame fixed between lower parts of said struts;

a fluid-actuated jack attached to said jack supporting frame and extending substantially vertically in parallel to said struts, said jack including a cylinder and a piston slidably mounted in said cylinder, one of said cylinder and said piston being fixed to said jack supporting frame and constituting a fixed jack member, and the other of said cylinder and said piston constituting a movable jack member;

a rotary member rotatably mounted to an upper end of said movable jack member;

a support frame protruding downwardly from said scaffolding floor;

an elongated flexible member having a first end fixed to said fixed jack member, a second end fixed to said support frame, and an intermediate portion engaged about said rotary member;

a substantially vertical guide frame fixed between lower parts of said struts; and guide components mounted to one of said guide frame and said support frame and slidably engaging the other of said guide frame and said support frame;

whereby movement of said movable jack member a first distance relative to said fixed jack member causes said scaffolding floor to be moved substantially twice said first distance.

10. An elevatable work facility as recited in claim 9, wherein said guide components have rollers for engaging said other of said guide frame and said support frame.

11. An elevatable work facility as recited in claim 9, further comprising fixing means for selectively fixing said outer casings of said struts to said inner casings of said struts, respectively, to fix said struts at a selected height.

12. An elevatable work facility as recited in claim 9, further comprising wheels mounted at lower ends of said struts, respectively.

13. An elevatable work facility as recited in claim 9, further comprising a ladder suspended downwardly from an outer peripheral edge of said scaffolding floor; and a ladder guiding frame mounted to said struts for guiding vertical movement of said ladder as said struts are adjusted in height.

14. An elevatable work facility as recited in claim 13, further comprising a back protection guide mounted to said ladder for surrounding a person climbing said ladder.

15. An elevatable work facility as recited in claim 9, wherein said fluid-actuated jack comprises a hydraulic jack.

* * * * *